US007207549B2

(12) United States Patent
Crawford

(10) Patent No.: US 7,207,549 B2
(45) Date of Patent: Apr. 24, 2007

(54) APPARATUS FOR ASSISTING IN THE REMOVAL AND INSTALLATION OF VEHICLE COMPONENTS

(76) Inventor: Earl F. Crawford, 1608 S. Fares Ave., Evansville, IN (US) 47716

( * ) Notice: Subject to any disclaimer, the term of this patent is extended or adjusted under 35 U.S.C. 154(b) by 196 days.

(21) Appl. No.: 11/132,530

(22) Filed: May 19, 2005

(65) Prior Publication Data

US 2006/0261320 A1 Nov. 23, 2006

(51) Int. Cl.
*B66B 3/00* (2006.01)

(52) U.S. Cl. ..... 254/134; 254/2 B

(58) Field of Classification Search ..... 254/134, 254/133.3 R, 10 B, 9 B, 2 B; 269/17
See application file for complete search history.

(56) References Cited

U.S. PATENT DOCUMENTS 5,632,475 A * 5/1997 McCanse ..... 269/17
2002/0120254 A1* 8/2002 Julian et al. ..... 606/1
2005/0234327 A1* 10/2005 Saracen et al. ..... 600/407
2006/0261320 A1* 11/2006 Crawford ..... 254/134

* cited by examiner

*Primary Examiner*—Lee D. Wilson
(74) *Attorney, Agent, or Firm*—C. Richard Martin

(57) ABSTRACT

An improved apparatus for assisting in the removal and installation of vehicle components such as doors, hoods, deck lids, bumpers and/or the like during assembly, disassembly and/or repair by using an expandable metal fixture attached to a portable engine hoist is provided. The apparatus includes a central telescoping fixture assembly formed of a plurality of parallel tubes secured together by a mounting plate on the rear face thereof. An upper telescoping tube assembly is provided comprising one or more tubes having a first end slidably engaging and extending outwardly from the central fixture assembly tubes and second ends affixed to a cross bar assembly. Also provided is a lower telescoping tube assembly comprising a tube having a first end slidably engaging and extending outwardly from a central fixture assembly tube and a second end affixed to a cross bar assembly. An articulating arm subassembly is provided to connect the central telescoping fixture assembly to a lifting apparatus such as an engine hoist. The articulating arm assembly permits the position of the device to be altered and removably fixed in relation to three separate axes.

20 Claims, 10 Drawing Sheets

APPARATUS FOR ASSISTING IN THE REMOVAL AND INSTALLATION OF VEHICLE COMPONENTS

BACKGROUND OF THE INVENTION

This invention relates generally to an apparatus for assisting in the removal and installation of vehicle components. More specifically, this invention relates to a device for supporting automotive vehicle doors, hoods, deck lids, bumpers and/or the like during assembly, disassembly and/or repair by using an expandable metal fixture attached to a portable engine hoist.

A variety of different devices have been used to assist individual users in removal and installation of doors, hoods, deck lids and bumpers during automobile repair and/or restoration projects. Door dollies, such as those manufactured by Brut Manufacturing Co., have previously been used to remove and install automobile doors during repair and restoration projects. While such devices perform well in the removal and installation of automobile doors, their size and configuration are not well suited for use in connection with other automobile body parts such as bumpers, deck lids and hoods. Brut also manufactures and sells a truck bed lifter which enables a truck bed to be lifted and removed from its frame by a single operator with the assistance of an engine hoist. That device works well for truck beds, but lacks any mechanism to adjust the position of the truck bed once it has been removed. Further, the truck bed lifter, because of its size and configuration, is not well suited for use in connection with other automobile parts such as doors, hood, deck lids, bumpers and the like.

Thus, none of the prior art devices are versatile enough to be used to install and/or remove a variety of automobile body parts including hoods, doors, deck lids and bumpers. Further, none of the prior art devices provide a tool that is adjustable along three separate axes and can be quickly and easily affixed to a lifting device such as an engine hoist.

SUMMARY OF THE INVENTION

It is an object of my invention to provide a novel apparatus for assisting in the removal and installation of a variety of vehicle components such as hoods, doors, bumpers and deck lids.

It is a further object of my invention to provide an apparatus that is portable and can be used by a single operator to remove and/or install automobile body parts such as hoods, bumpers, doors, deck lids and the like.

It is a further object to provide an apparatus that is adjustable along three separate axes to allow precise positioning of the automobile body part at the time of installation or removal.

Briefly, in accordance with my invention there is provided an apparatus for assisting in the removal and installation of vehicle components, such as hoods, doors and bumpers. The apparatus includes a central telescoping fixture assembly having a front face and a rear face. The central telescoping, fixture is formed of a plurality of parallel tubes secured together by a mounting plate on the rear face thereof. Preferably, the central telescoping fixture assembly includes three parallel tubes secured together by said mounting plate. An upper telescoping tube assembly is provided comprising one or more tubes having a first end slidably engaging and extending outwardly from one or more of said plurality of central fixture assembly tubes and second ends affixed to a cross bar assembly. According to a preferred embodiment, the upper telescoping assembly comprises two tubes slidably engaging and extending outwardly from the two outer parallel tubes of the central fixture assembly. Also provided is a lower telescoping tube assembly comprising one or more tubes having a first end slidably engaging and extending outwardly from one or more of said plurality of central fixture assembly tubes and second ends affixed to a cross bar assembly. A preferred embodiment of the lower telescoping assembly includes one tube slidably engaging and extending outwardly from the center parallel tube of the central fixture assembly. Means for releasably engaging said upper and lower assembly tubes in relation to the central assembly tubes are also provided.

The upper cross bar assembly according to one aspect of the invention comprises a top cross-tube, a pair of extension arms, and a pair of gripping arms. The top cross-tube has a first end and a second end and is positioned perpendicular to and affixed to the upper ends of the two upper telescoping assembly tubes. The pair of extension arms each include a first end slidably engaging and extending into the respective first and second ends of the top cross-tube. Also provided are meals for releasably engaging each extension arm in relation to the top cross-tube.

Each of the pair of gripping arms extends outwardly from a second end of each of the respective extension arms in an outward direction from the front face of the central telescoping fixture assembly. Means for releasably engaging each gripping arms in relation to the respective extension arm end is also provided. Each of said pair of gripping arms preferably comprises a round bar extension having a bend therein for receiving an upper edge of a vehicle component such as a hood.

A u-shaped gripping arm extending outwardly from a central region of the top cross-tube may also be provided according to one aspect of the invention. The u-shaped gripping arm extends in an outward direction from the front face of said central telescoping fixture assembly. Also provided are means for releasably engaging said u-shaped gripping arm in relation to the top cross-tube. The releasable engaging means permit adjustment of the distance between the u-shaped gripping arm and top cross-tube to secure an upper edge of a vehicle component such as a door.

The lower cross bar assembly includes a bottom cross-tube, a pair of round bar boss assemblies and means for releasably engaging said pair of round bar boss assemblies in relation to the bottom cross-tube. The bottom cross-tube has a first end and a second end and is positioned perpendicular to and affixed to the lower end of the lower telescoping assembly. Each one of the pair of round bar boss assemblies is slidably disposed about the bottom cross-tube. The first round bar boss assembly is movably positioned between a midpoint and the first end of the bottom cross-tube, and the second round bar boss assembly is slidably positioned between the midpoint and second end of the bottom cross-tube.

Each round bar boss assembly further comprises a telescoping tube section and a first boss assembly extending from a bottom surface thereof. The first boss assembly includes a circular opening in a front face thereof for receiving a gripping arm extending therefrom in an outward direction from the front face of the central telescoping fixture assembly. A corresponding pair of second boss assemblies may also be provided extending from the bottom surface of each said telescoping tube section. Each second boss assembly includes a circular opening in a front face thereof for receiving a gripping arm extending therefrom in an outward direction from the front face of the central telescoping fixture assembly. The circular opening in the second boss assembly is of a diameter less than the diameter of said circular opening in the first boss assembly so as to accommodate a gripping arm of lesser diameter. Releasable engaging means are provided for releasably engaging the first pair of gripping arms in relation to the respective first boss assemblies and for releasably engaging said second pair of gripping arms in relation to the respective second boss assemblies. Each of the first pair or gripping arms may comprise a round tube extension having a 45 degree bend therein for receiving a bottom edge of a vehicle component such as a door, and may further include a flange extending outwardly from a surface of the round bar extension on a side of the bar opposite the bend. Each of the second pair or gripping arms may comprise a round bar extension having a 90 degree bend therein for receiving a bottom edge of a vehicle component such as a hood.

The positioning of the apparatus is accomplished by an articulating arm assembly which is affixed to the mounting plate of the central fixture assembly by its own mounting plate. A mounting arm is provided for connecting the apparatus to a lift mechanism. Articulating means connect the mounting arm to the mounting plate and provide for rotation of the mounting plate along three separate axes of rotation in relation to the mounting arm.

The articulating arm assembly includes an axle extending from a rear surface of the mounting plate, a vertical and rotational indexing assembly fixedly secured to said axle, an articulating arm, and a horizontal indexing assembly. The vertical and rotational indexing assembly includes an indexing plate spacer having a planar surface parallel to the surface of the mounting plate. The vertical and rotational indexing assembly also includes a pair of spacer-lugs extending perpendicularly from opposing lateral surfaces thereof and having coaxial opening disposed therein. The articulating arm link includes a first end connected to the vertical and rotational indexing assembly by a pivot pin having a horizontally extending axis to permit rotation of the apparatus about said axis thereby altering the position of the apparatus in relation to the vertical axis. The horizontal indexing assembly is rotatably connected to a second end of the articulating arm link by a clevis pin. The horizontal indexing assembly further includes means for securing the horizontal indexing assembly and articulating arm link in one of a plurality of fixed positions.

The articulating arm assembly may further include a semi-circular shaped indexing plate affixed to a lateral edge of the indexing plate spacer. The semi-circular indexing plate has a semi-circular slot formed therein adjacent the curved edge thereof for receiving the threaded portion of a first threaded bolt having an enlarged head. The first threaded bolt extends through the semi-circular slot into a threaded opening in the articulating arm link for selectively securing the apparatus against rotation about the axis of the indexing plate spacer pivot pin.

The articulating arm assembly may further include a pie-shaped indexing plate affixed to and extending upwardly from a top edge of the indexing plate spacer. The pie-shaped indexing plate includes a semi-circular slot formed therein adjacent the curved edge thereof for receiving a second threaded bolt having an enlarged head. The threaded portion of said bolt extends through the semi-circular slot in the pie-shaped indexing plate into a threaded opening in the central telescoping fixture assembly for selectively securing the apparatus against rotation. The pie-shaped indexing plate may further include a flange extending therefrom between said indexing plate spacer and said mounting plate. The flange includes a circular opening therein such that the axle extending from the mounting plate passes through said opening. A compression spring may further be positioned about the axle between the mounting plate and the flange for placing said flange into frictional engagement with said mounting plate.

These and other objects, features and advantages of the present invention will become apparent to those skilled in the art from the following detailed description and attached drawings upon which, by way of example, only the preferred embodiments of my invention are illustrated.

DESCRIPTION OF THE PREFERRED EMBODIMENT

Figure 1:
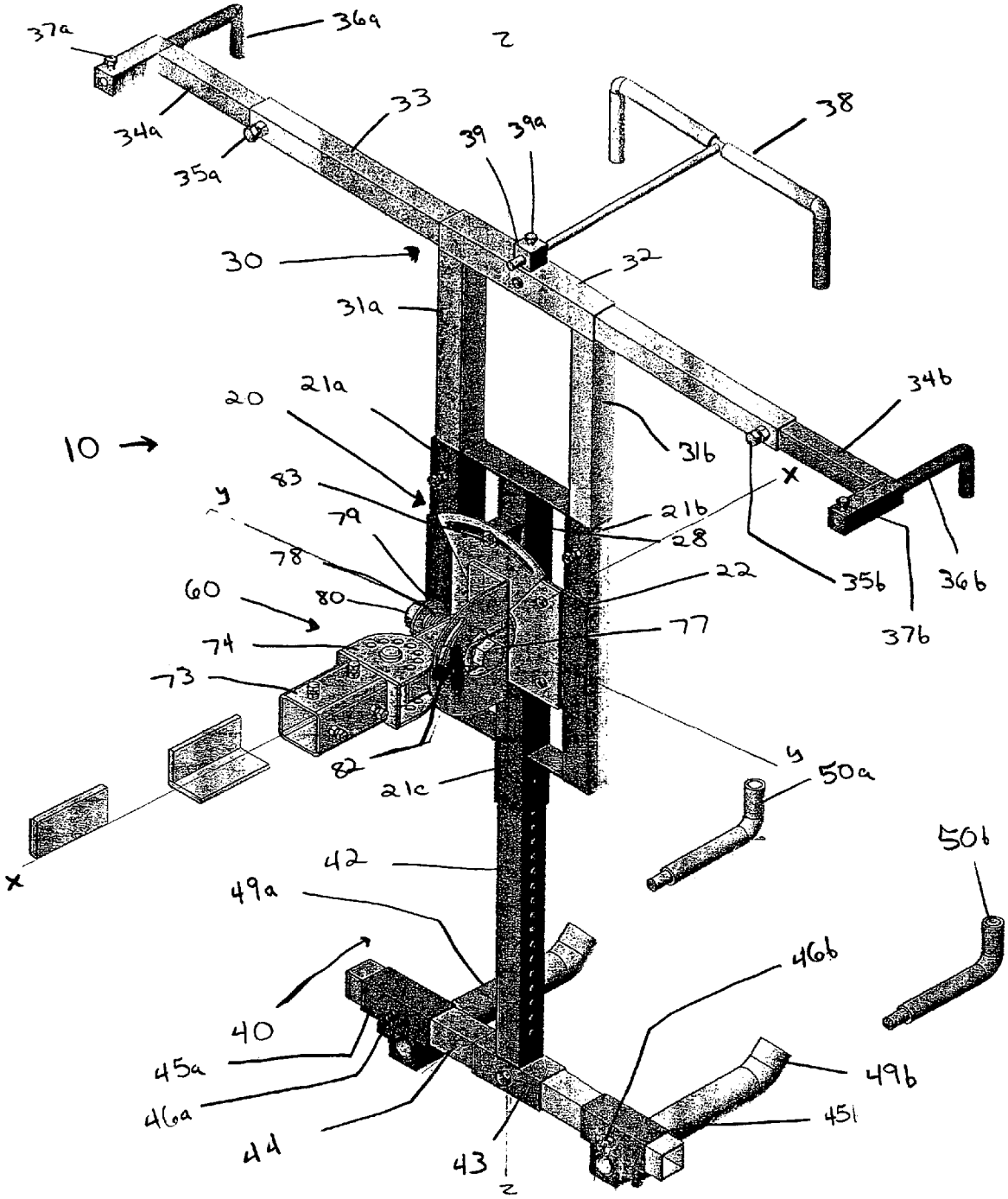
FIG. 1 shows a rear perspective view of an apparatus for assisting in the removal and installation of vehicle components according to one preferred embodiment of the present invention.
Figure 2:
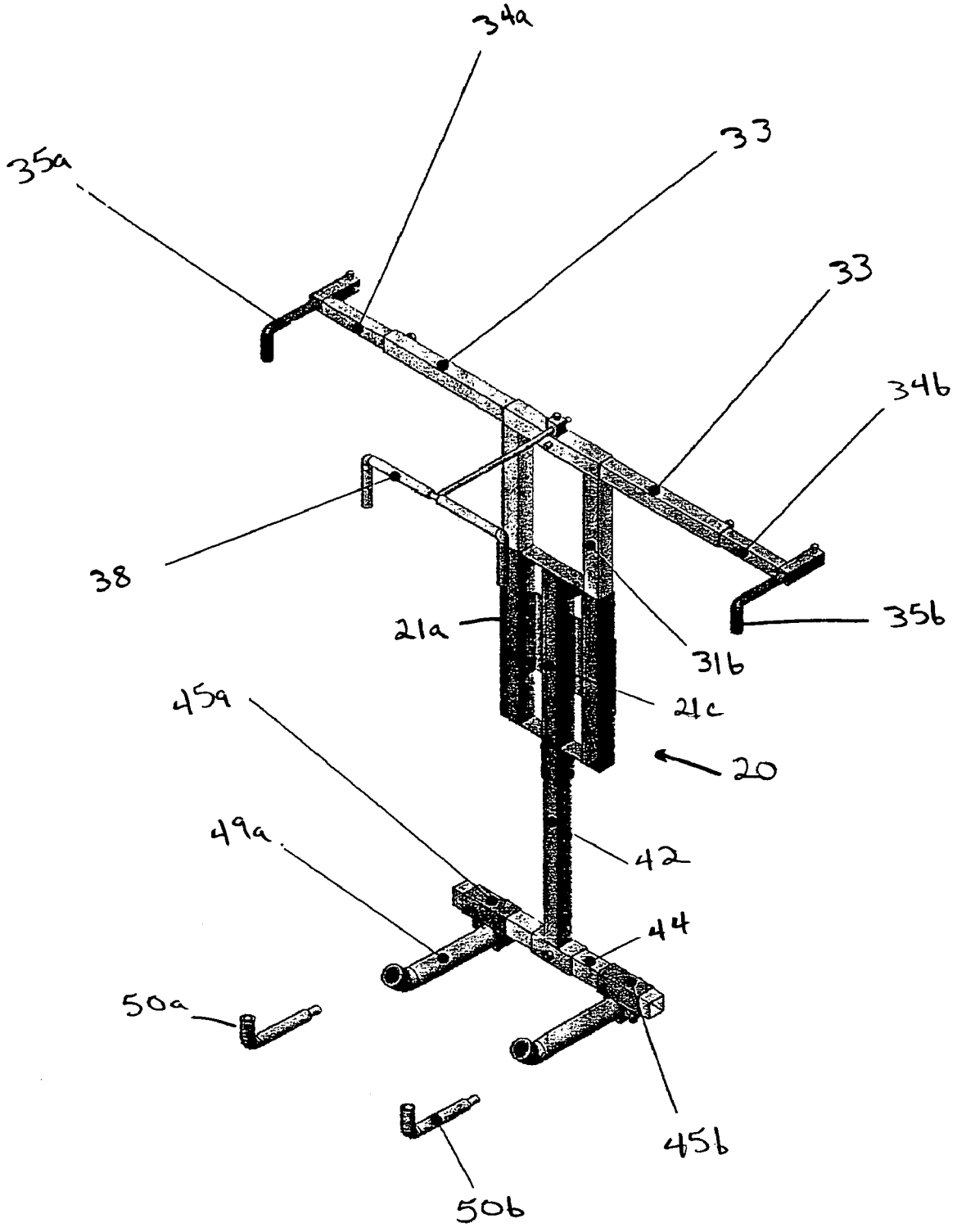
FIG. 2 shows a front perspective view of the apparatus for assisting in the removal and installation of vehicle components shown in FIG. 1.

Referring now to the drawings and, in particular, to FIG. 1 and FIG. 2, there is shown in a preferred embodiment of my invention, a component handling apparatus 10 for assisting in the removal and installation of vehicle components, such as hoods, doors, bumpers and the like. The component handling apparatus 10 preferably includes a central telescoping fixture assembly 20, an upper telescoping tube assembly 30, a lower telescoping tube assembly 40, and an articulating arm assembly 60.

Figure 3:
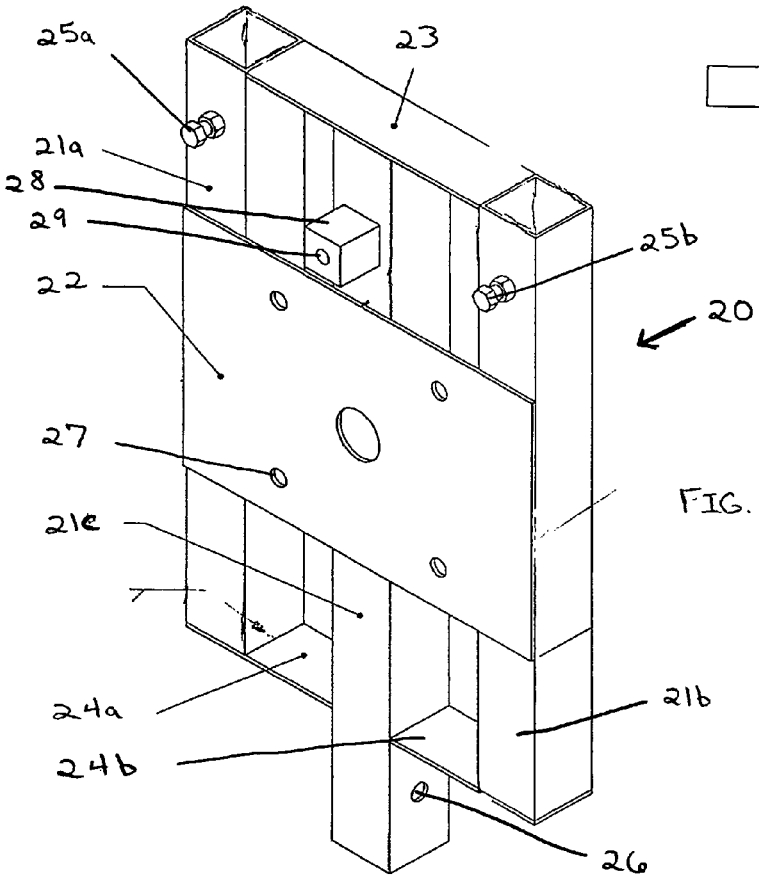
FIG. 3 shows a rear perspective view of a central telescoping fixture assembly being a component of the preferred embodiment of an apparatus for assisting in the removal and installation of vehicle components shown in FIG. 1.

As most clearly shown in FIG. 3, the central telescoping fixture assembly 20 includes three parallel tubes 21*a*, 21*b*, 21*c* secured together by a mounting plate 22 on a rear face thereof. In addition, the tubes are secured together at their respective upper ends by a reinforcing bar 23, which is secured to the tubes such that the two outer tubes 21*a*, 21*b* remain open at the upper end thereof. Similarly, the tubes are secured together at or near their respective lower ends by one or more lower reinforcing bars 24, such that the central tube 21*c* remains open at its lower end. Preferably, the lower end of the central tube 21*c* extends beyond the lower end of the outer tubes 21*a*, 21*b* and a pair of lower reinforcing bars 24*a*, 24*b* are used to secure the respective outer tubes 21*a*, 21*b* to the central tube 21*c*.

Securing bolts 25*a*, 25*b* are provided in the respective central assembly tubes 21*a*, 21*b* near the upper ends thereof to selectively secure the upper telescoping tube assembly 30 to the central telescoping fixture assembly 20. According to one preferred embodiment, a hole is formed in a surface of each of the respective central assembly tubes and a nut is welded to the tube about the opening. A threaded bolt is then inserted into the nut and rotated until the distal end thereof protrudes through the opening into engagement with the outer surface of the respective upper assembly tubes 31*a*, 31*b* securing the upper and central assemblies together.

An opening 26 is formed through the central tube 21*c* proximal to the lower end thereof for selectively securing the lower telescoping tube assembly 40 to the central telescoping fixture assembly 20. According to one preferred embodiment, a plurality of corresponding openings 41 are formed in a vertical tube 42 of the lower telescoping tube assembly. The desired vertical positioning of the lower assembly is determined and the nearest corresponding opening 41 in the vertical tube 42 is aligned with the opening in the central tube 21*c*. A removable pin (not shown) is then inserted through the aligned openings 41, 26 to secure the positioning of the lower assembly 40 relative to the central assembly 20.

Figure 4:
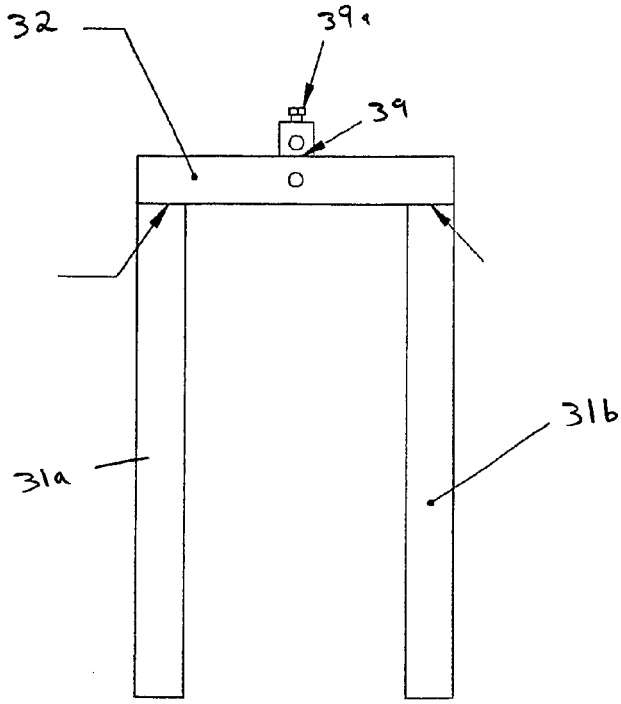
FIG. 4 shows a front plan view of an upper telescoping tube assembly being a component of the preferred embodiment of an apparatus for assisting in the removal and installation of vehicle components shown in FIG. 1.
Figure 5A:
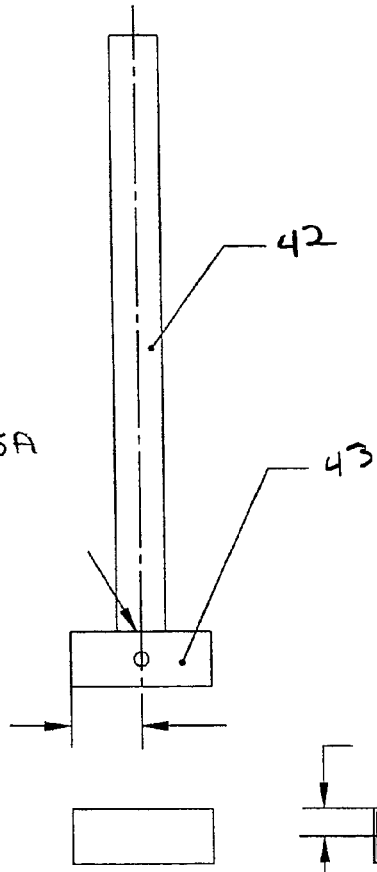
FIG. 5A shows a front plan view of a lower telescoping tube assembly being a component of the preferred embodiment of an apparatus for assisting in the removal and installation of vehicle components shown in FIG. 1.
Figure 5B:
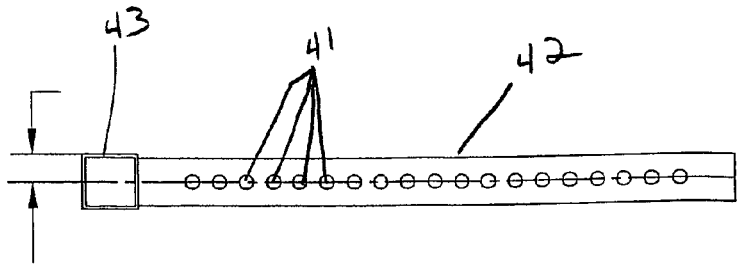
FIG. 5B shows a side plan view of the lower telescoping tube assembly shown in FIG. 5A.
Figure 10:
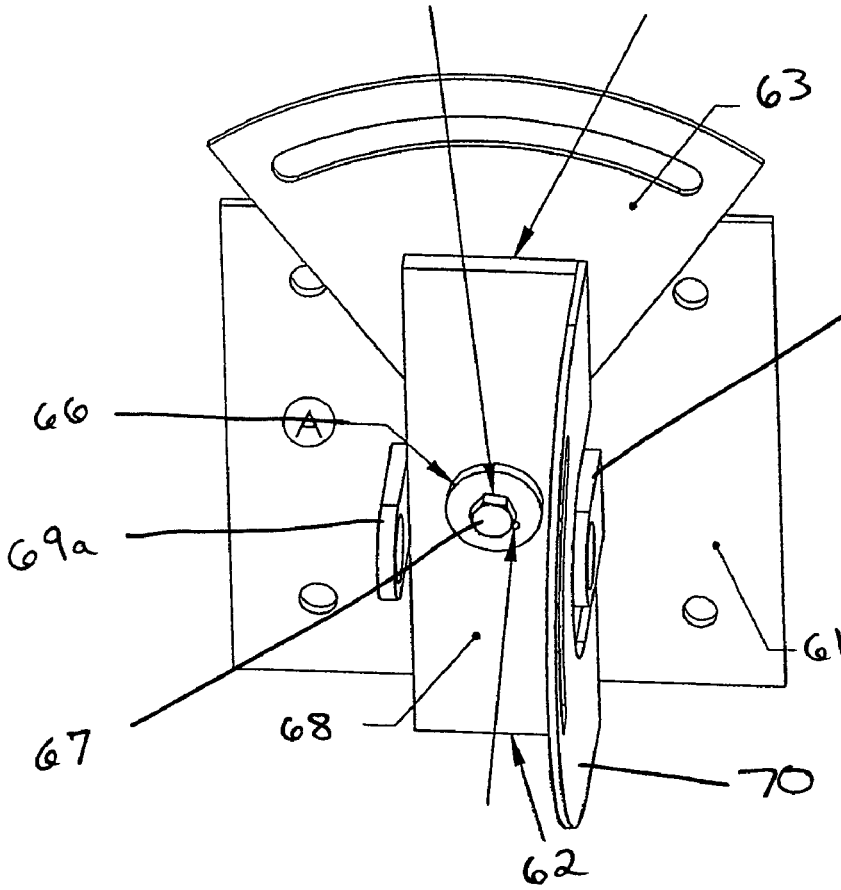
FIG. 10 shows an alternative perspective view of a portion of the articulating arm assembly shown in FIG. 8.
Figure 9:
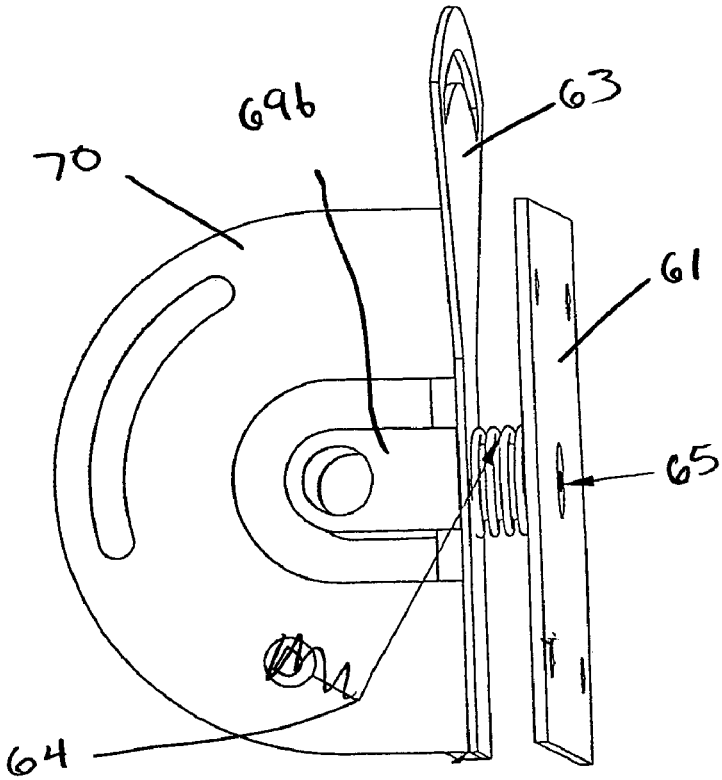
FIG. 9 shows a side perspective view of a portion of the articulating arm assembly shown in FIG. 8.
Figure 11:
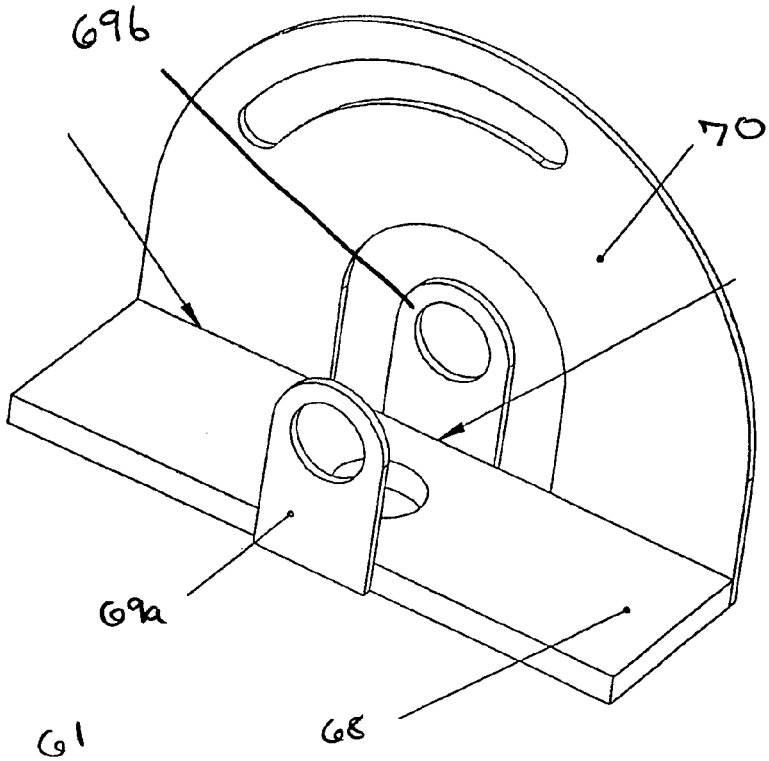
FIG. 11 shows a perspective view of an indexing plate assembly being a component of the articulating arm assembly shown in FIG. 8.
Figure 13:
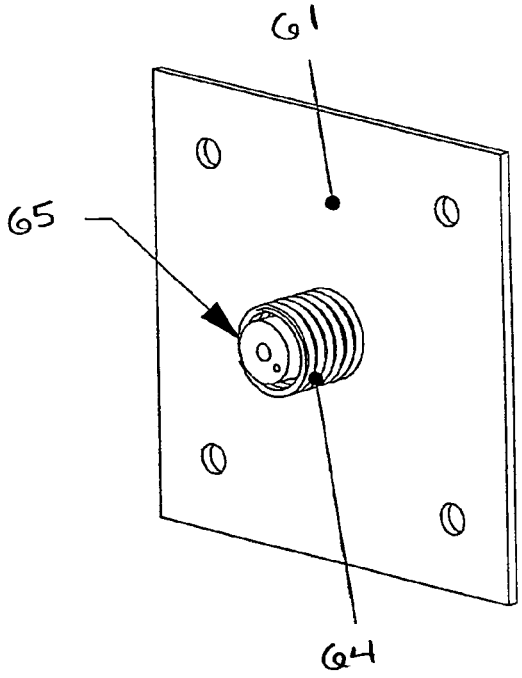
FIG. 13 shows a perspective view of a mounting plate assembly being a component of the articulating arm assembly shown in FIG. 8.
Figure 12:
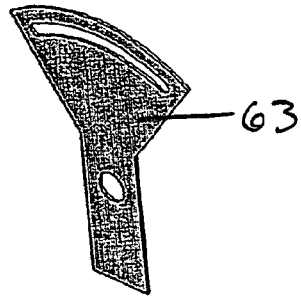
FIG. 12 shows a perspective view of an indexing plate being a component of the articulating arm assembly shown in FIG. 8.
Figure 14:
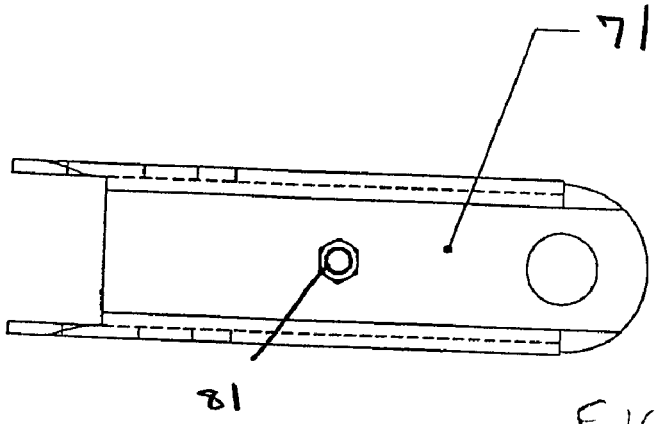
FIG. 14 shows a perspective view of an index plate assembly being a component of the articulating arm assembly shown in FIG. 8.
Figure 15:
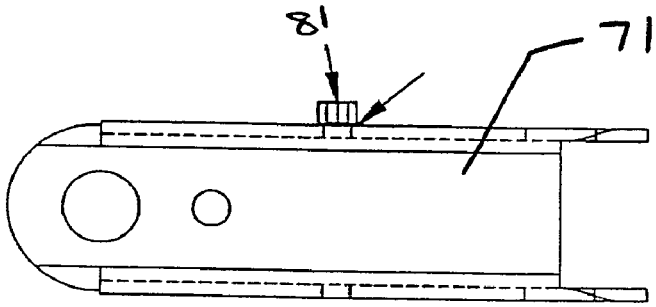
FIG. 15 shows a side plan view of the index plate assembly shown in FIG. 14.

As best shown in FIG. 4, the upper telescoping tube assembly 30 includes a pair of parallel tubes 31*a*, 31*b* connected at an upper end thereof by a cross bar assembly 32, thereby forming a substantially unshaped assembly. The parallel tubes 31*a*, 31*b* are spaced apart a distance corresponding to the spacing between the central assembly tubes 21*a*, 21*b* and have outer dimensions slightly less than the inner dimensions of the central assembly tubes 21*a*, 21*b* such that the upper assembly tubes 31*a*, 31*b* telescopically extend into the openings in the upper ends of the central assembly tubes 21*a*, 21*b*. This allows for the vertical position of the cross bar assembly and engaging means associated therewith to be adjusted by sliding the upper assembly tubes 31*a*, 31*b* into or out of the central assembly tubes 21*a*, 21*b*.

The upper telescoping tube assembly further includes a telescoping cross-bar 33 as best shown in FIGS. 1 & 2. The telescoping cross-bar 33 has outer dimensions slightly less than the inner dimensions of the cross bar assembly 32 such that the telescoping cross-bar 33 telescopically extends through the cross bar assembly 32 and protrudes from each end thereof. According to one preferred embodiment, a midpoint of the telescoping cross-bar 33 is removably secured to the midpoint of the cross bar assembly 32 by a removable fastener such as a bolt.

Into each end of the telescoping cross bar 33 is inserted an L-shaped telescoping tube member 34*a*, 34*b*, respectively. Securing bolts 35*a*, 35*b* are provided in the telescoping cross-bar 33 near the ends thereof to selectively secure the respective L-shaped telescoping tube members 34*a*, 34*b* to the ends of the telescoping cross bar 33. According to one preferred embodiment, a hole is formed in a surface near each end of the telescoping cross bar 33 and a nut is welded to the tube about the opening. A threaded bolt is then inserted into the nut and rotated until the distal end thereof protrudes through the opening into engagement with the outer surface of the respective L-shaped telescoping tube members 34*a*, 34*b* securing them to the telescoping cross bar 33.

Round bar extension assemblies 36*a*, 36*b*, protrude outwardly from openings in the respective L-shaped telescoping tube members 34*a*, 34*b* toward the front face of the component handling apparatus 10. The round bar extension assemblies 36*a*, 36*b* have a hook or bend in a distal end thereof to assist in engaging the surface of an automobile component, such as a hood. According to the preferred embodiment shown in the figures, the round bar extension assemblies are substantially L-shaped. A proximal end of each round bar extension assembly 36*a*, 36*b* is telescopically received in a corresponding circular opening in an end region of the corresponding L-shaped telescoping tube member 34*a*, 34*b*. Securing bolts 37*a*, 37*b* are provided in the each L-shaped telescoping tube members 34*a*, 34*b*, respectively, near the bend thereof to selectively secure the respective each round bar extension assembly 36*a*, 36*b*. According to one preferred embodiment, a hole is formed in a surface near each bend of the L-shaped telescoping tube members 34*a*, 34*b* and a nut is welded to the tube about the opening. A threaded bolt is then inserted into the nut and rotated until the distal end thereof protrudes through the opening into engagement with the outer surface of the respective round bar extension assembly 36*a*, 36*b* securing them to the L-shaped telescoping tube members 34*a*, 34*b*.

A central U-form assembly 38 may also be attached to the cross bar assembly 32 of the upper telescoping tube member for handling automobile components, such as doors. The central U-form assembly 38 comprises a substantially U-shaped round arm having a connecting rod extending from a central region thereof. The distal end of the connecting rod is removably attached to the cross bar assembly 32 by a securing mechanism 39. The securing mechanism 39 comprises a metallic block which is attached to an upper surface of the cross bar assembly 32, preferably by welding. The block includes an opening passing therethrough in the horizontal axis for receiving the distal end of the connecting rod of the U-shaped assembly 38. A securing bolt 39*a* is provided in the securing mechanism 39 to selectively secure the distal end of the U-form assembly 38. According to one preferred embodiment, a hole is formed in an upper surface of the securing mechanism 39 and a nut is welded to the tube about the opening. A threaded bolt is then inserted into the nut and rotated until the distal end thereof protrudes through the opening into engagement with the outer surface of the connecting rod of the U-shaped assembly 38 securing it against movement.

The lower telescoping tube assembly 40, which is best shown in FIGS. 1, 2, 5A & 5B preferably includes a vertical tube 42 having a first end slidably engaging and extending outwardly from the central tube 21*c* of the central telescoping fixture assembly 20 and second end affixed to a lower cross bar assembly 43. The lower telescoping tube assembly further includes a telescoping cross-bar 44 as best shown in FIGS. 1 & 2. The telescoping cross-bar 44 has outer dimensions slightly less than the inner dimensions of the cross bar assembly 43 such that the telescoping cross-bar 44 telescopically extends through the cross bar assembly 43 and protrudes from each end thereof. According to one preferred embodiment, a midpoint of the telescoping cross-bar 44 is removably secured to the midpoint of the cross bar assembly 43 by a removable fastener such as a bolt.

Round bar boss assemblies 45*a*, 45*b*, each including a telescoping tube member are positioned each end of the telescoping cross-bar 44. The telescoping cross-bar 44 has outer dimensions slightly less than the inner dimensions of the telescoping tube member of the round bar boss assemblies 45*a*, 45*b* such that round bar boss assemblies fit over the outer surface of the telescoping cross-bar and are slidable along the longitudinal axis thereof. Securing bolts 46*a*, 46*b* are provided in the respective round bar boss assemblies 45*a*, 45*b* to selectively secure the round bar boss assemblies 45*a*, 45*b* to the telescoping cross-bar 44. According to one preferred embodiment, a hole is formed in a surface of each round bar boss assemblies 45*a*, 45*b* and a nut is welded to the tube about the opening. A threaded bolt is then inserted into the nut and rotated until the distal end thereof protrudes through the opening into engagement with the outer surface of the telescoping cross-bar 44 thereby securing the round bar boss assemblies from sliding along the longitudinal axis of the telescoping cross-bar 44.

Figure 7:
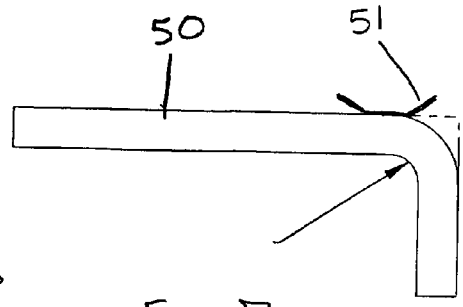
FIG. 7 shows a side plan view of a round bar extension being of component of the preferred embodiment of an apparatus for assisting in the removal and installation of vehicle components shown in FIG. 1.
Figure 6:
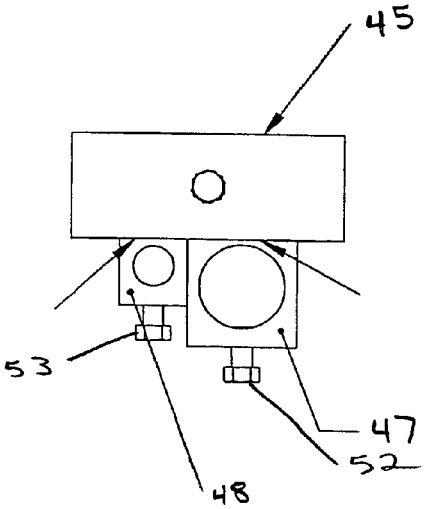
FIG. 6 shows a front plan view of a round bar boss assembly being a component of the preferred embodiment of an apparatus for assisting in the removal and installation of vehicle components shown in FIG. 1.
Figure 8:
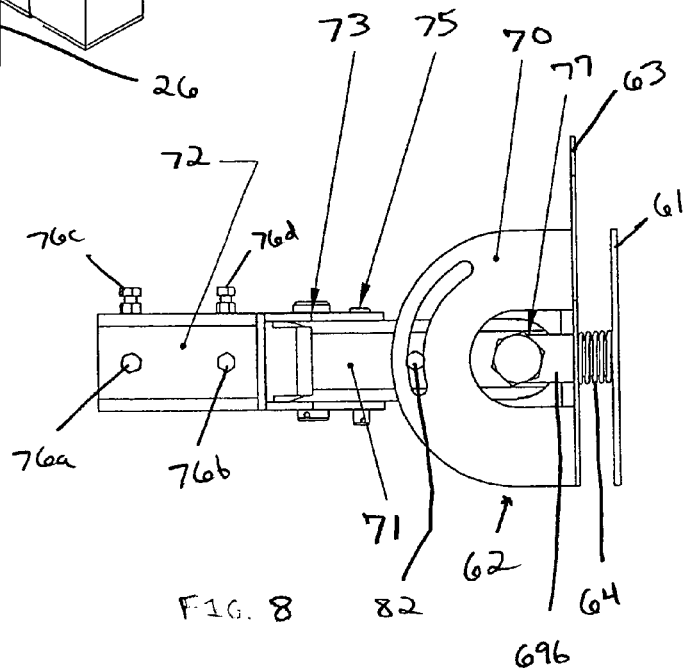
FIG. 8 shows a side plan view of an articulating arm assembly being a component of the preferred embodiment of an apparatus for assisting in the removal and installation of vehicle components shown in FIG. 1.

As most clearly shown in FIG. 6, a large boss assembly 47 and a small boss assembly 48 are affixed to a lower surface of the telescoping tube of the round bar boss assembly 45. The large boss assembly 47 has an opening therein for receiving a first end of a large round bar extension 49. The second end of the large round bar extension is bent upwardly to secure a vehicle component when positioned thereon. Preferably, the second tube end is bent at a 45 degree angle in relation to the longitudinal axis thereof. The small boss assembly 48 also has an opening therein for receiving a first end of a small round bar extension 50. The second end of the small round bar extension is bent upwardly to secure a vehicle component when positioned thereon. Preferably, the second tube end is bent at a 90 degree angle in relation to the longitudinal axis thereof. As best shown in FIG. 7, on the side opposite the bend, a secondary flange 51 having two upwardly angled projecting arms is provided. Securing bolts 52, 53 are provided in the respective large boss assembly 47 and a small boss assembly 48 to selectively secure the respective large round bar extension 49 and small round bar extension 50 thereto. According to one preferred embodiment, a hole is formed in a surface of each boss assemblies 47, 48 and a nut is welded to the tube about the opening. A threaded bolt is then inserted into the nut and rotated until the distal end thereof protrudes through the opening into engagement with the outer surface of the respective large round bar extension 49 or small round bar extension 50 thereby securing the round bar extension in relation to the boss assembly.

The articulating arm assembly 60, as shown in FIGS. 1 & 2 includes a mounting plate 61 affixed to the central fixture assembly mounting plate 22, a mounting arm, and articulating means connecting the mounting arm to the mounting plate 61. The articulating means provides for rotation of the mounting plate 61 along three separate axes of rotation in relation to the mounting arm. The articulating means and the various components thereof are shown in detail in FIGS. 8–16.

The articulating means, or mounting plate subassembly, of the articulating arm assembly 60 includes the mounting plate 61, a 75 degree indexing assembly 62, a 60 degree indexing plate 63, a compression spring 64, a mounting plate axle 65, axle washer 66 and bolt 67. The 75 degree indexing assembly further includes an indexing plate spacer 68 having an opening in a central region thereof to receive the mounting plate axle 65, a pair of indexing plate spacer-lugs 69*a*, 69*b* extending outwardly from the front surface thereof along opposing lateral edges of the indexing plate spacer 68, and a substantially semi-circular shaped indexing plate 70 extending outwardly from the front surface thereof along one of said opposing lateral edges of the indexing plate spacer 68. The semi-circular indexing plate 70 includes an arc-shaped slot adjacent the outer edge thereof. According to the embodiment shown in the drawings, the slot is of sufficient length to permit 75 degrees of rotation. The indexing plate spacer-lugs 69*a*, 69*b* and 75 degree indexing plate 70 are preferably connected to the indexing plate spacer 68 by welds. The 60 degree indexing plate 63 preferably consists of a metal plate having a substantially pie-shaped region connected to a narrow rectangular shaped region. The 60 degree indexing plate 63 also includes a round opening in the rectangular region and a slot adjacent the outer edge of the pie-shaped region, with said slot being of sufficient length to permit 60 degrees of rotation. The round opening in the rectangular shaped region is aligned with the opening in 75 degree indexing plate spacer, and the 60 degree indexing plate is affixed to the 75 degree indexing assembly, preferably by welding.

The mounting plate axle 65 extends outwardly from the center of the mounting plate 61 and passes through the aligned openings in the 60 degree indexing plate 63 and 75 degree indexing assembly 62 respectively. The axle washer 66 is then placed on the end of the axle 65 and a bolt 67 is inserted through the washer opening into a threaded opening in the center of the axle 65. The washer 66 and distal end of the axle 65 each have a small hole therein for receiving a dowel pin that connects the washer to the axle in order to maintain radial alignment of components when the bolt is tightened. A compression spring 64 is positioned about the axle 65 between the mounting plate 61 and indexing plate assembly 62. The compression spring 64 serves to hold the indexing plate assembly in a fixed position in relation to the mounting plate until rotary pressure is applied to change the position.

Figure 16:
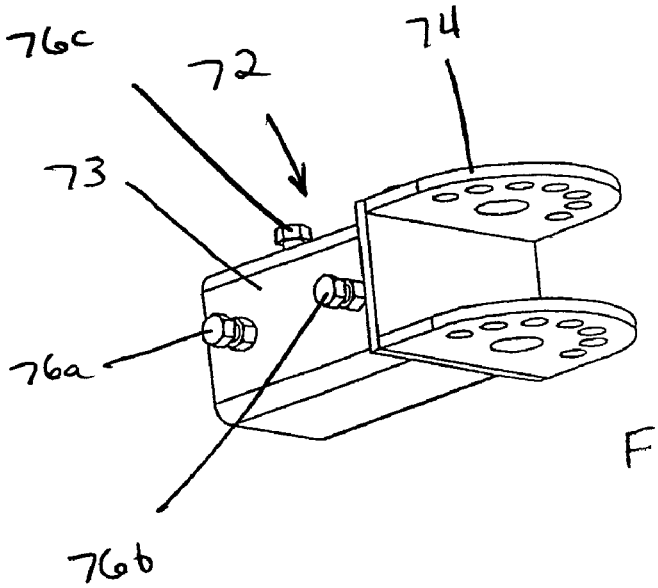
FIG. 16 shows a side plan view of the index plate assembly shown in FIG. 8.

The mounting arm of the apparatus includes an articulating arm link 71 having a first end connected to a vertical and rotational indexing assembly 72 by a pivot pin 73 having a horizontally extending axis to permit rotation of the apparatus about said axis thereby altering the position of the apparatus in relation to the vertical axis. The vertical and rotational indexing assembly 72 is best shown in FIG. 16 and comprises a tubular receiver 73 having a first end open for receiving the arm of a lifting tool such as an engine hoist, and a second end affixed to a index plate assembly 74. The index plate assembly preferably includes seven pairs of openings therein which permit the device to be secured in one of seven different positions relative to the x-axis as shown in FIG. 1. A clevis pin 75 is inserted through a pair of opening in the index plate assembly and an opening in the articulating arm link to secure the device in one of the seven pre-set positions relative to the x-axis. Securing bolts 76*a*, 76*b*, 76*c*, 76*d* are provided in the tubular receiver 73 to selectively secure the component handling apparatus 10 to the arm of a lifting tool, such as an engine hoist. According to one preferred embodiment, a hole is formed in a surface of tubular receiver 73 and a nut is welded to the tube about the opening. A threaded bolt is then inserted into the nut and rotated until the distal end thereof protrudes through the opening into engagement with the outer surface of the lifting tool arm thereby securing the component handling apparatus 10 to the lifting tool.

The second end of the articulating arm link 71 is connected to the 75 degree indexing assembly 62 by bolt 77 which passes through concentric an opening in a first indexing plate spacer-lug 69*a*, then through openings in the second end of the articulating arm link 71 and through the second indexing plate spacer-lug 69*b*. A compression spring 78 is then fitted about the shaft of the bolt 77 protruding beyond the second spacer-lug 69*b*, a washer 79 inserted, and a nut 80 is then threaded onto the bolt shaft. The bolt assembly allows the apparatus to be pivoted relative to the z-axis shown in FIG. 1. The compression spring 78 holds the device in a substantially upright position unless pressure is applied thereto by the operator to adjust the position of the apparatus in relation to the z-axis. A nut 81 is welded to the surface of the articulating arm link and is aligned with the slot in the 75 degree index plate 70. A bolt 82 with an enlarged head is inserted through the slot in the 75 degree index plate 70 and threadably engages the nut 81. The bolt 82 can be rotated until the underside of the enlarged head comes into frictional engagement with the 75 degree index plate 70 thereby securing the position of the apparatus in relation to the z-axis.

As best shown in FIG. 1, a spacer block 28 is positioned on the central tube 21*c* of the central telescoping fixture assembly 20 such that it projects toward the articulating arm assembly 60. The block 28 has a threaded opening 29 in the rear face thereof. A bolt 83 with an enlarged head is inserted through the slot in the 60 degree index plate 63 and threadably engages the opening 29 in the block 28. The bolt 83 can be rotated until the underside of the enlarged head comes into frictional engagement with the 60 degree index plate 63 thereby securing the position of the apparatus in relation to the y-axis.

Figure 17:
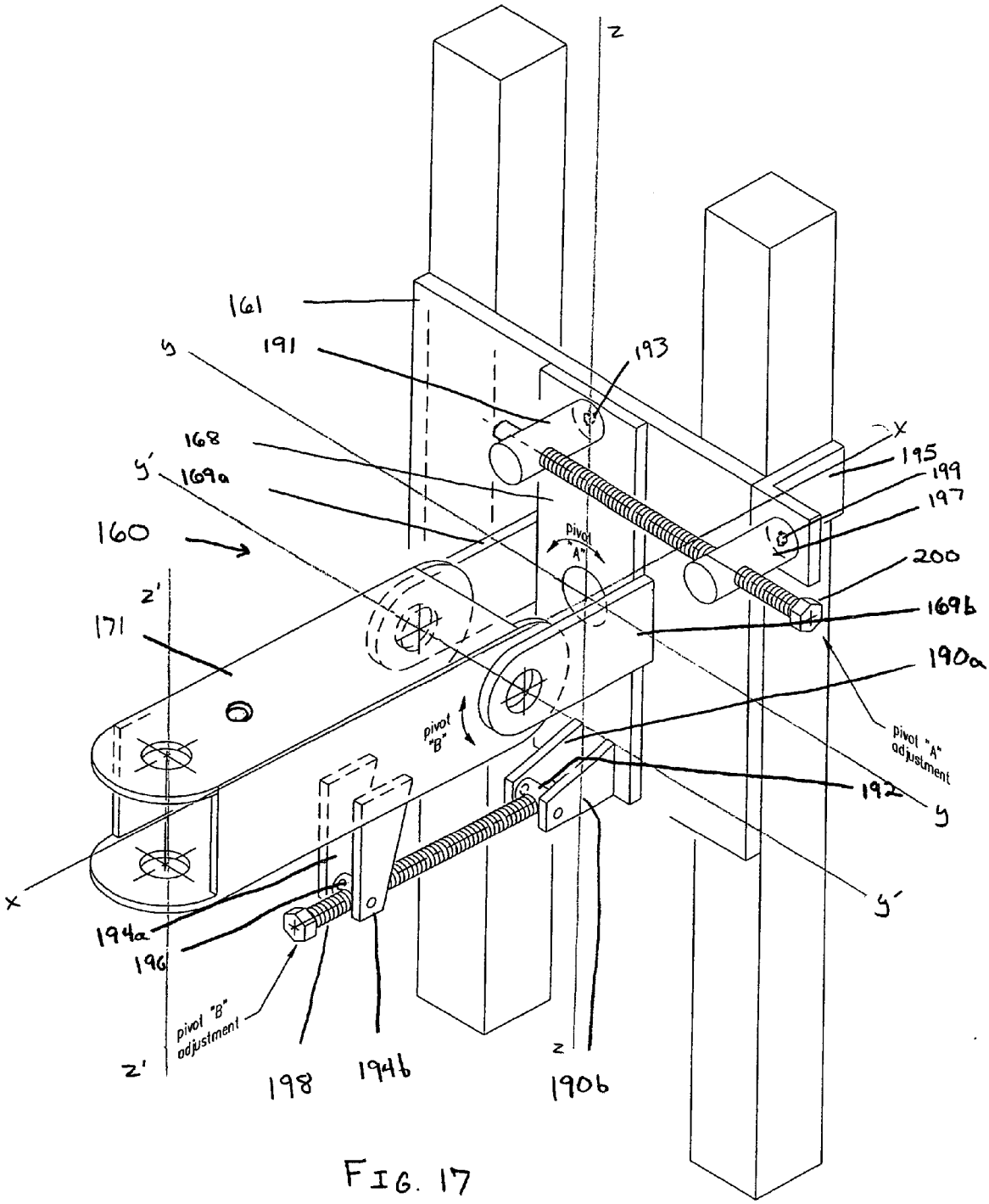
FIG. 17 shows a rear perspective view of an articulating arm assembly according to a second, alternative embodiment, being a component of the preferred embodiment of an apparatus for assisting in the removal and installation of vehicle components shown in FIG. 1.
Figure 18:
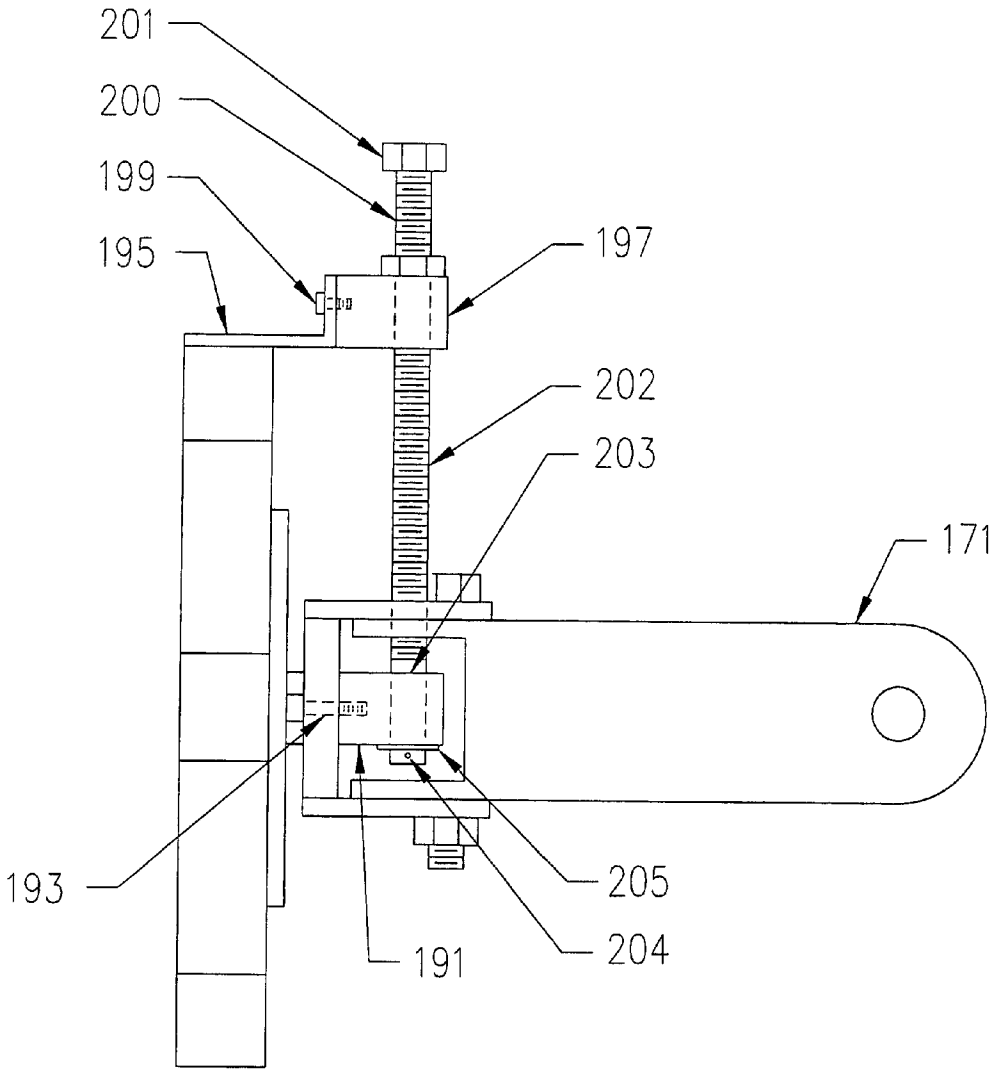
FIG. 18 shows a top plan view of the articulating arm assembly shown in FIG. 17.
Figure 19:
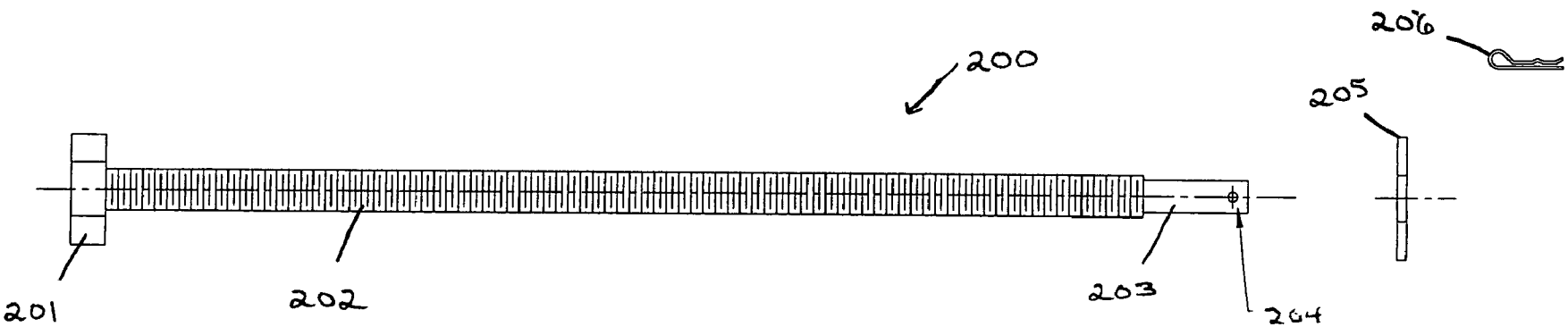
FIG. 19 shows an exploded side view of the ACME rod and nut assembly used in the articulating arm assembly of the second embodiment shown in FIGS. 17 and 18.

An alternative embodiment of the articulating arm assembly 160 is shown in FIGS. 17–19, wherein like reference numerals indicate like components. However, instead of using compression springs to hold the apparatus in position relative to the y and z axes, ACME threaded rod and nut combinations are used. To secure and position the apparatus in relation to the y'-axis, a pair of flanges 190*a*, 190*b* project upwardly from the surface of the indexing plate spacer 168. A solid steel ACME nut 192 with an unthreaded hole is then positioned between the flanges 190*a*, 190*b* such that the nut can rotate freely in relation to the flanges. A pair of flanges 194*a*, 194*b* also project from a surface of the articulating arm link 171, and a solid steel ACME nut 196 with a threaded hole is positioned between those flanges 194*a*, 194*b* such that the nut can rotate freely in relation to the flanges. An ACME threaded rod 198 is then threaded through the threaded ACME nut 196 between flanges 194*a*, 194*b* and into the opening in the unthreaded ACME nut 192 between flanges 190*a*, 190*b*. Clockwise rotation of the ACME threaded rod causes the distance between the two ACME nuts to increase, thereby pivoting the apparatus counterclockwise about the y'-axis. Likewise, rotating the ACME threaded rod in a counterclockwise direction causes the distance between the two ACME nuts to decrease, thereby pivoting clockwise about the y'-axis.

Similarly, to secure and position the apparatus in relation to the x-axis, a barrel flange 191 projects upwardly from the surface of the indexing plate spacer 168. The barrel flange 191 is connected to the indexing plate spacer by a pivot pin 193 which permits the barrel flange to freely rotate about the pivot pin in relation to the indexing plate spacer 168. The barrel flange 191 has an unthreaded hole formed therein. A flange 195 also projects from a surface of the mounting plate 161, the flange 195 being pivotally connected to a second barrel flange 197 by a pivot pin 199. The second barrel flange 197 includes a threaded opening 197 therein for threadably receiving an ACME threaded rod 200. The ACME threaded rod 200 extends through the threaded opening of the second barrel flange 197 into the unthreaded opening in the first barrel flange 191. Clockwise rotation of the ACME threaded rod causes the distance between the two ACME nuts to increase, thereby pivoting the apparatus counterclockwise about the "A" pivot point or x-axis. Likewise, rotating the ACME threaded rod in a counterclockwise direction causes the distance between the two ACME nuts to decrease, thereby pivoting the apparatus clockwise about the "A" pivot point or x-axis.

The configuration and operation of the ACME threaded rod and nut assembly is best shown in FIGS. 18–19. The ACME threaded rod 200 has a head 201, a threaded portion 202 and a tapered, unthreaded portion 203 at a terminal end thereof. The outer diameter of the unthreaded portion 203 is slightly less than the outer diameter of the threaded portion 202 so that it freely rotates within the unthreaded opening in the first barrel flange 191. The diameter of the threaded portion 202 of the ACME threaded rod is also larger than the diameter of the unthreaded opening in the first barrel flange 191 so that the shoulder between the unthreaded portion 203 and threaded portion 202 of the ACME threaded rod prevents the threaded portion from entering the unthreaded opening in the first barrel flange 191. Thus, when the ACME threaded rod is rotated clockwise, the length of shaft between the second barrel flange 197 and first barrel flange 191 increases, causing counterclockwise rotation of the apparatus about the x-axis. A washer 205 secured in place by an cotter-pin 206 inserted through a hole 205 in the shaft prevents the end of the ACME rod from leaving the unthreaded opening in the first barrel flange 191 when the rod 200 is rotated in a counterclockwise direction, pulling the first barrel flange 191 back toward the second barrel flange 197 thereby effecting clockwise rotation of the apparatus about the x-axis.

In order to assist with the removal and installation of some components, such as bumpers, a securing strap may be utilized to secure the component to the apparatus. Stretchable straps, such as bungee-straps may be used, or non-stretchable straps combined with a ratchet mechanism may be used to tighten the strap around the component securing it to the apparatus.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

I claim:

1. An apparatus for assisting in the removal and installation of vehicle components comprising:

a central telescoping fixture assembly having a front face and a rear face comprising a plurality of parallel tubes secured together by a mounting plate on the rear face thereof;

an upper telescoping tube assembly comprising one or more tubes having a first end slidably engaging and extending outwardly from one or more of said plurality of central fixture assembly tubes and second ends affixed to a cross bar assembly;

a lower telescoping tube assembly comprising one or more tubes having a first end slidably engaging and extending outwardly from one or more of said plurality of central fixture assembly tubes and second ends affixed to a cross bar assembly; and an articulating arm assembly comprising a mounting plate affixed to the mounting plate of the central fixture assembly, a mounting arm, and articulating means connecting said mounting arm to said mounting plate, said articulating means providing for rotation of the mounting plate along three separate axes of rotation in relation to the mounting arm.

2. The apparatus of claim 1 wherein the central telescoping fixture assembly comprises three parallel tubes secured together by said mounting plate.

3. The apparatus of claim 2 wherein the upper telescoping assembly comprises two tubes slidably engaging and extending outwardly from the two outer parallel tubes of the central fixture assembly.

4. The apparatus of claim 3 wherein the lower telescoping assembly comprises one tube slidably engaging and extending outwardly from the center parallel tube of the central fixture assembly.

5. The apparatus of claim 4 further comprising means for releasably engaging said upper and lower assembly tubes in relation to the central assembly tubes.

6. The apparatus of claim 5 wherein the upper cross bar assembly comprises:

a top cross-tube positioned perpendicular to and affixed to the upper ends of said two upper telescoping assembly tubes, said top cross-tube having a first end and a second end;

a pair of extension arms, each having a first end slidably engaging and extending into said first and second ends of said top cross-tube, respectively;

means for releasably engaging said pair of extension arms in relation to the top cross-tube;

a pair of gripping arms, each extending outwardly from a second end of respective said pair of extension arms in an outward direction from the front face of said central telescoping fixture assembly; and means for releasably engaging said pair of gripping arms in relation to the second ends of the extension arms.

7. The apparatus of claim 6, wherein each of said pair of gripping arms comprises a round bar extension having a bend therein for receiving an upper edge of a vehicle component such as a hood.

8. The apparatus of claim 6, further comprising:

a u-shaped gripping arm extending outwardly from a central region of the top cross-tube in an outward direction from the front face of said central telescoping fixture assembly; and means for releasably engaging said u shaped gripping arm in relation to the top cross-tube to adjust the distance between the u-shaped gripping arm and top cross-tube to secure an upper edge of a vehicle component such as a door.

9. The apparatus of claim 5 wherein the upper cross bar assembly comprises:

a top cross-tube positioned perpendicular to and affixed to the upper ends of said two upper telescoping assembly tubes, said top cross-tube having a first end and a second end;

a u-shaped gripping arm extending outwardly from a central region of the top cross-tube in an outward direction from the front face of said central telescoping fixture assembly; and means for releasably engaging said u shaped gripping arm in relation to the top cross-tube to adjust the distance between the u-shaped gripping arm and top cross-tube to secure an upper edge of a vehicle component such as a door.

10. The apparatus of claim 5 wherein the lower cross bar assembly comprises:

a bottom cross-tube positioned perpendicular to and affixed to the lower end of said lower telescoping assembly tube, said bottom cross-tube having a first end and a second end;

a pair of round bar boss assemblies slidably disposed about said bottom cross-tube such that a first round bar boss assembly is movably positioned between a midpoint and the first end of said bottom cross-tube, and a second round bar boss assembly is slidably positioned between the midpoint and second end of said bottom cross-tube; and means for releasably engaging said pair of round bar boss assemblies in relation to the bottom cross-tube.

11. The apparatus of claim 10, wherein each round bar boss assembly further comprises a telescoping tube section; a first boss assembly extending from a bottom surface of said telescoping tube section, wherein said first boss assembly include a circular opening in a front face thereof for receiving a gripping arm extending therefrom in an outward direction from the front face of said central telescoping fixture assembly.

12. The apparatus of claim 11 further comprising means for releasably engaging said pair of gripping arms in relation to the respective first boss assemblies.

13. The apparatus of claim 11 further comprising a second boss assembly extending from the bottom surface of each said telescoping tube section, said second boss assembly having a circular opening in a front face thereof for receiving a gripping arm extending therefrom in an outward direction from the front face of said central telescoping fixture assembly, said circular opening in the second boss assembly being of a diameter less than the diameter of said circular opening in the first boss assembly so as to accommodate a gripping arm of lesser diameter.

14. The apparatus of claim 13 further comprising means for releasably engaging said first pair of gripping arms in relation to the respective first boss assemblies, and means for releasably engaging said second pair of gripping arms in relation to the respective second boss assemblies.

15. The apparatus of claim 14 wherein said first pair or gripping arms comprise a round tube extension having a 45 degree bend therein for receiving a bottom edge of a vehicle component such as a door.

16. The apparatus of claim 14 wherein said second pair or gripping arms comprise a round bar extension having a 90 degree bend therein for receiving a bottom edge of a vehicle component such as a hood.

17. The apparatus of claim 16 further comprising a flange extending outwardly from a surface of the round bar extension on a side of the bar opposite the bend.

18. The apparatus of claim 5, wherein said articulating arm assembly further comprises:

an axle extending from a rear surface of said mounting plate;

a vertical and rotational indexing assembly fixedly secured to said axle, said vertical and rotational indexing assembly having an indexing plate spacer having a planar surface parallel to the surface of the mounting plate, said vertical and rotational indexing assembly also having a pair of spacer-lugs extending perpendicularly from opposing lateral surfaces thereof and having coaxial opening disposed therein;

an articulating arm link having a first end connected to said vertical and rotational indexing assembly by a pivot pin having a horizontally extending axis to permit rotation of the apparatus about said axis thereby altering the position of the apparatus in relation to the vertical axis;

a horizontal indexing assembly rotatably connected to a second end of said articulating arm link by a clevis pin, said horizontal indexing assembly including means for securing said horizontal indexing assembly and said articulating arm link in one of a plurality of fixed positions.

19. The apparatus of claim 18, further comprising:

a semi-circular shaped indexing plate affixed to a lateral edge of the indexing plate spacer, said semi-circular indexing plate having a semi-circular slot formed therein adjacent the curved edge of said semi-circular indexing plate;

a pie-shaped indexing plate affixed to and extending upwardly from a top edge of the indexing plate spacer, said pie-shaped indexing plate having a semi-circular slot formed therein adjacent the curved edge of said pie-shaped indexing plate;

a first threaded bolt having an enlarged head, the threaded portion of said bolt extending through the semi-circular slot in the semi-circular shaped indexing plate into a threaded opening in said articulating arm link for selectively securing the apparatus against rotation about the axis of the indexing plate spacer pivot pin; and a second threaded bolt having an enlarged head, the threaded portion of said bolt extending through the semi-circular slot in the pie-shaped indexing plate into a threaded opening in said central telescoping fixture assembly for selectively securing the apparatus against rotation.

20. The apparatus of claim 19, further comprising:

a flange extending from said pie-shaped indexing plate between said indexing plate spacer and said mounting plate and having a circular opening therein such that the axle extending from the mounting plate passes through said opening; and a compression spring positioned about the axle between the mounting plate and the flange for placing said flange into frictional engagement with said mounting plate.

* * * * *